US011034172B2

(12) United States Patent
Maya Agudo et al.

(10) Patent No.: US 11,034,172 B2
(45) Date of Patent: Jun. 15, 2021

(54) FEEDING A PRINT MEDIUM AND PRINTER

(71) Applicant: HEWLETT-PACKARD DEVELOPMENT COMPANY, L.P., Spring, TX (US)

(72) Inventors: Isidoro Maya Agudo, Sant Cugat del Valles (ES); Eduardo Martin Orue, Sant Cugat del Valles (ES); Daniel Gonzalez Perello, Sant Cugat del Valles (ES); Daniel Nunez Fernandez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/464,652

(22) PCT Filed: Mar. 28, 2017

(86) PCT No.: PCT/US2017/024601
§ 371 (c)(1),
(2) Date: May 28, 2019

(87) PCT Pub. No.: WO2018/182583
PCT Pub. Date: Oct. 4, 2018

(65) Prior Publication Data

US 2019/0308426 A1 Oct. 10, 2019

(51) Int. Cl.
*B41J 13/00* (2006.01)
*B41J 11/00* (2006.01)
(Continued)

(52) U.S. Cl.
CPC ..... *B41J 13/0009* (2013.01); *B41J 2/515* (2013.01); *B41J 11/001* (2013.01); *B41J 11/0085* (2013.01); *B41J 15/005* (2013.01); *B65H 5/224* (2013.01); *B65H 7/00* (2013.01); *B65H 2404/264* (2013.01); *B65H 2511/22* (2013.01); *B65H 2515/342* (2013.01)

(58) Field of Classification Search
CPC ..... B41J 13/0009; B41J 2/515; B41J 15/005; B41J 11/001; B41J 11/0085; B65H 5/224; B65H 7/00; B65H 2515/342; B65H 2404/264; B65H 2511/22
See application file for complete search history.

(56) References Cited

U.S. PATENT DOCUMENTS 8,083,228 B2 12/2011 deJong et al.
8,702,094 B2 4/2014 Mandel et al.
(Continued)

OTHER PUBLICATIONS

HPDC, "International Search Report and Written Opinion," dated Nov. 30, 2017, International App. No. PCT/US2017/024601, 8 p.

*Primary Examiner* — Yaovi M Ameh
(74) *Attorney, Agent, or Firm* — HP Inc. Patent Department

(57) ABSTRACT

A method of feeding a print medium comprises receiving a print medium by a media advance system; transporting the print medium by the media advance system to a print zone wherein the transporting comprises applying a first normal force when the print medium is at a first position of the media advance system and applying a second normal force when the print medium is at a second position of the media advance system, wherein the second normal force is different from the first normal force.

12 Claims, 6 Drawing Sheets

(51) Int. Cl.

| | |
|---|---|
| ***B65H 5/22*** | (2006.01) |
| ***B65H 7/00*** | (2006.01) |
| ***B41J 15/00*** | (2006.01) |
| ***B41J 2/515*** | (2006.01) |

(56) References Cited

U.S. PATENT DOCUMENTS

| | | | | |
|---|---|---|---|---|
| 8,870,331 | B2 | 10/2014 | Mo et al. | |
| 8,926,086 | B2 | 1/2015 | Cressman et al. | |
| 9,452,621 | B2 | 9/2016 | Saito et al. | |
| 2004/0246508 | A1* | 12/2004 | Smith | H04N 1/00665 358/1.6 |
| 2009/0244244 | A1* | 10/2009 | Sawada | B41J 11/0085 347/104 |
| 2010/0066781 | A1 | 3/2010 | Niihara et al. | |
| 2010/0213666 | A1* | 8/2010 | Harney | B65H 5/222 271/276 |
| 2012/0024470 | A1* | 2/2012 | Hundorf | A61F 13/15658 156/250 |
| 2014/0208970 | A1 | 7/2014 | Weidmann | |
| 2016/0031663 | A1 | 2/2016 | Herrmann | |

* cited by examiner

FEEDING A PRINT MEDIUM AND PRINTER

BACKGROUND

Scanning printers are based on a system with two perpendicular axes: the media advance axis and the print head scan axis. The media advance axis defines the movement and position of a print medium below a print head when the print head prints a swath of printing fluid. The print head scan axis defines the movement of a print head carriage carrying the print head. A firing pulse is generated in response to the position of the print head in the print head scan axis. The firing pulse is a signal used by the print head to fire a drop of printing fluid while the media is static below the carriage.

A Page Wide Array (PWA) printer has an axis architecture in which the print head carriage is replaced by an array of nozzles that extends in a width direction across a print zone and does not move. The print medium moves through the print zone, with the media advance axis perpendicular to the width direction of the array of pens. A firing pulse is generated in a respective nozzle in response to the media movement.

The media advance axis also is referred to as Y direction, and the print head scan axis or nozzle array width also is referred to as X direction. Media position errors in the X direction might cause print image quality issues.

DESCRIPTION OF EXAMPLES

Figure 1:
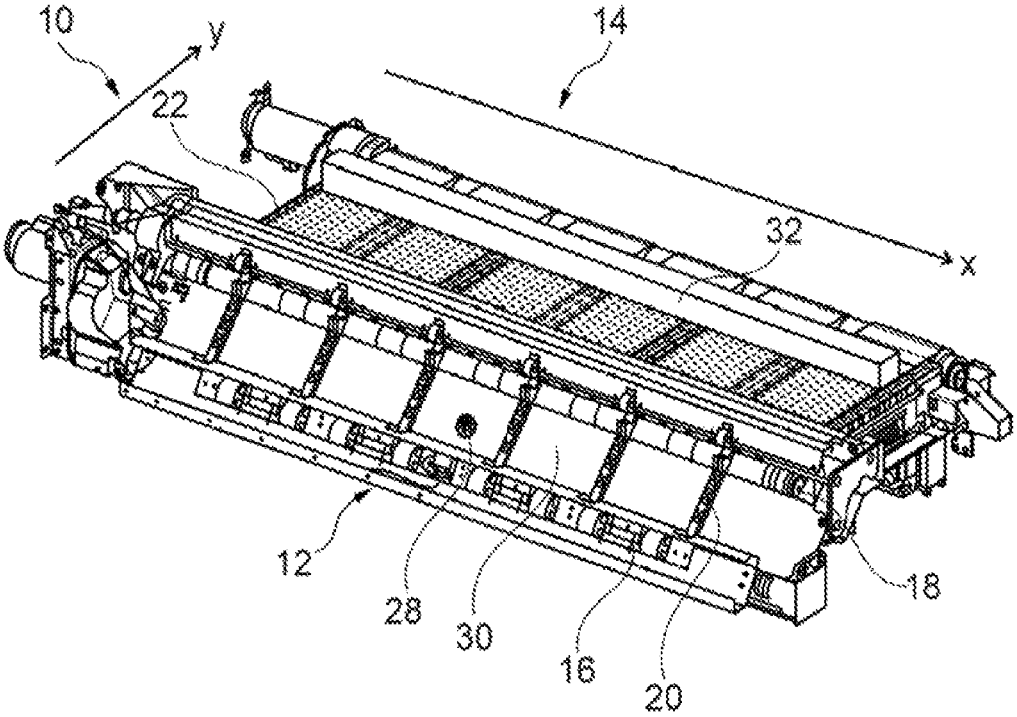
FIG. 1 shows a perspective view of part of a printer according to an example.

FIGS. 1 and 2A to 2C show a perspective view and cross-sections through a part of a printer according to an example. The printer of this example is a page wide array printer wherein the figures show a media advance system 10 arranged between a media input 12 and a media output 14. A print medium, such as a single sheet or a continuous web of print media is fed to the media input side from an input tray, a drawer or roll of paper, for example. The media advance system 10 provides certain features to isolate the media movement between the feeder and the media advance system. The media advance system 10 generates a bubble or curvature in the print medium while being transported and while printing to avoid back tension, to enable printing without stopping media transport, and to allow cutting of the print media while printing.

The media advance system 10 comprises a first set of feed rollers/pinch wheel pairs 16 and a second set of pinch wheels 18, and a number of movable baffles 20 between the first set and the second set. A print medium 100 (see FIGS. 2B and 2C) is fed to the first set of feed rollers/pinch wheel pairs 16, and once the leading edge of the print medium 100 has passed the first set 16, the baffles 20 are raised (see FIG. 2B), e.g. by rotating the baffles 20 around an axis 20' to lift a front end 20" of each baffle 20. This causes the print medium to be lifted up and deform to generate a media bubble 102 or curvature (in the following, referred to as media bubble) while it continues to be fed to the second set of pinch wheels 18 and from there to a platen and set of vacuum belts 22 (see FIG. 2C). A positive difference between the feed roller speed of the first set 16 and the speed of the vacuum belts 22 allows generating and maintaining the media bubble 102 upstream of the vacuum belts 22. The media bubble 102 allows the first set of feed rollers/pinch wheel pairs 16 to stop feeding the print medium 100 when a print is about to be completed, cut the print medium 100, and start again the first set of feed rollers/pinch wheel pairs 16 to deliver the trailing edge of the print medium 100 without having to stop the printing operation. The second set of pinch wheels 18 ensures media flatness before the leading edge of the print medium reaches the vacuum belts 22.

A media bubble sensor 28 is provided between the first set of feed rollers/pinch wheel pairs 16 and the second set of pinch wheels 18 wherein the bubble sensor 28 can be extended from a guiding plate 30 or retracted behind the plate 30. FIG. 1 shows the bubble sensor 28 in the extended position. When a media bubble 102 is desired to allow cutting of the print medium 100, for example, the bubble sensor 28 can be extended to ensure a minimum media bubble size.

Figure 2A:
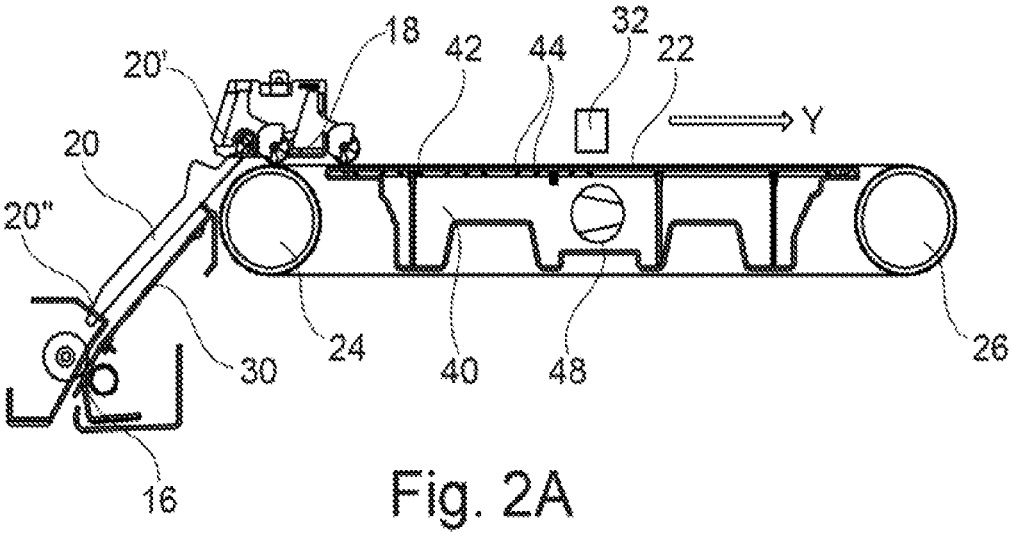
FIG. 2A to 2C show sectional views of part of a printer in different operating states, according to an example.
Figure 2B:
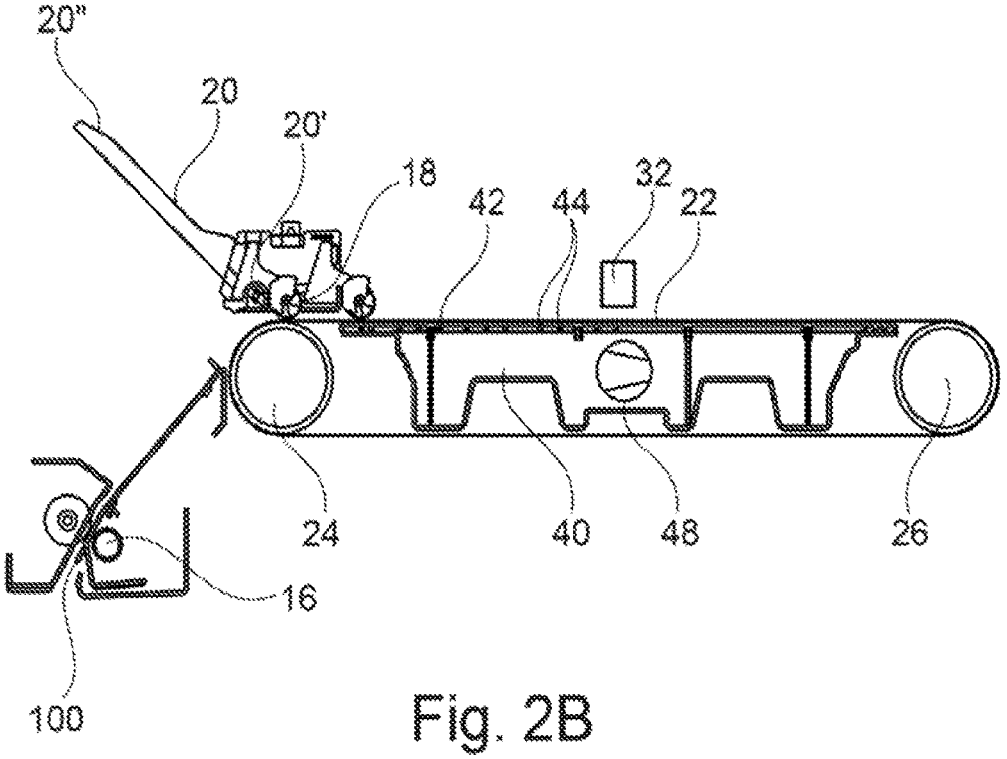
Figure 2C:
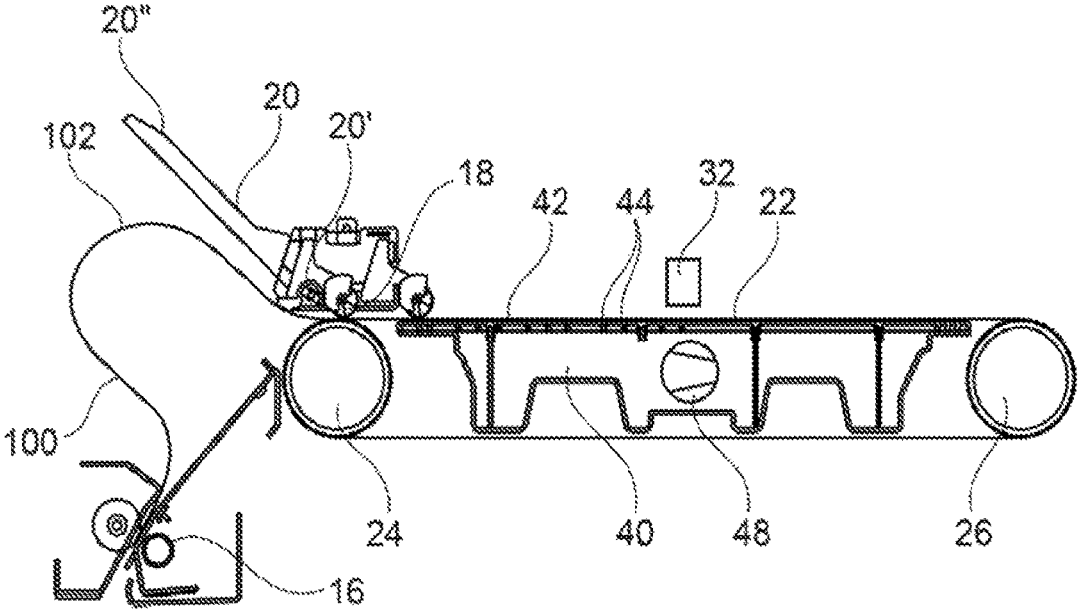

In this example, a print bar or print nozzle array 32 is schematically shown in FIGS. 1 and 2A to 2C, extending above a print zone (described with reference to FIGS. 3A and 3B) across the media advance system 10 in an X direction, perpendicular to the media advance direction Y. In FIG. 2A to 2C, the print bar 32 extends normal to the drawing plane.

In the example, the media advance system 10 comprises six parallel vacuum belts 22 which are driven by common idle/drive rollers 24 and 26. The media advance system 10 further comprises a vacuum chamber 40 that is formed underneath a platen 42 and is in fluid communication with the surface of the platen 42 through a plurality of suction ports 44. The vacuum chamber 40 can be partially evacuated by means of a vacuum generator, including a fan or pump 48 to reduce the pressure in the vacuum chamber 40 with respect to the atmospheric pressure in the surrounding environment. The vacuum generator may be provided within the vacuum chamber 40 or externally thereto, with a fluid connection to the vacuum chamber 40. It generates a suction force or vacuum force at the surface of the platen 42 which may be characterized in terms of a pressure that is locally decreased with respect to a pressure in a surrounding environment, in particular, locally decreased with respect to an atmospheric pressure. The vacuum force is transferred to the print medium 100 transported on the surface of the vacuum belt 22 and is translated into a normal force and a traction force which causes the print medium to follow the movement of vacuum belts 22.

The media advance system 10 further may include a position sensor (not shown) to detect a leading edge and/or a trailing edge of the print medium 100 when it is transported across the platen 42. A plurality of position sensors can be provided, e.g. at an upstream end and at a downstream end of the platen 42, and/or at an upstream end and at a downstream end of a print zone, in the media advance direction.

The media advance system 10 further may be coupled with a controller (not shown) for controlling movement and speed of the first set of feed rollers/pinch wheel pairs 16, and of the idle/drive rollers 24, 26, and further for controlling movement of the baffle 20. The controller further can control the vacuum level generated in the vacuum chamber 40. The controller can comprise one or a number of dedicated microcontrollers or other processing means.

Figures 3A, 3B:
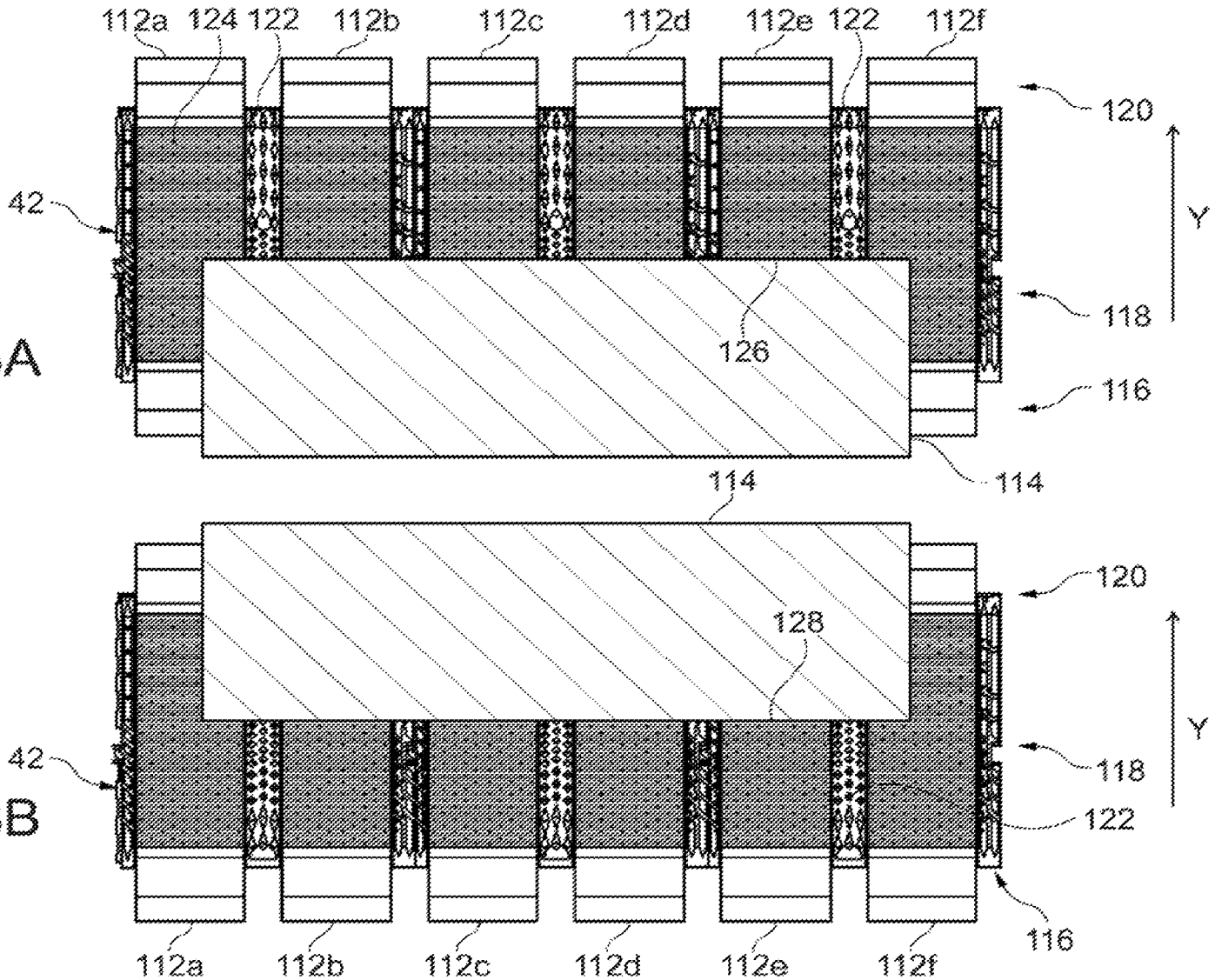
FIGS. 3A and 3B show top views of a media advance system according to an example.

FIGS. 3A and 3B are top views of a platen/belt portion of the media advance system 10 of a PWA printing device. In this portion, the media advance system comprises the platen 42 and a plurality of vacuum belts 112*a* to 112*f*, in this example six (6) belts, that transport a print medium 114, such as a sheet of paper or continuous web of paper from the second set of pinch wheels 18 through a print zone 118 to a media output zone 120 along a media advance direction Y (indicated by an arrow in FIGS. 3A and 3B). The vacuum belts 112*a* to 112*f* transport the print medium 114 to the print zone 118, where print heads print on the upper side of the print medium 114. The print heads are located above the platen 42 and the print medium 114 in the print zone 118, but are not shown in FIGS. 3A and 3B to streamline the presentation. The print heads may be provided in the form of a print bar, which includes an array of nozzles that extends in a width direction across a print zone and does not move. The print head alternatively may be provided in a carriage which scans across the print medium in a width direction of the print zone. Firing pulses are generated to eject droplets of printing fluid, either from the static print bar or from the scanning print heads, when the print medium is below the print heads in the print zone. Printing fluid may refer to a fluid that may be dispensed by an inkjet-type printer or other inkjet-type dispenser and may include inks, varnishes, and/or post/pre-treatment agents, for example. During printing, the print medium 114 is advanced continuously or incrementally to the media output zone 120 and output from the printing device.

FIG. 3A shows a scenario where the leading edge of the print medium 114 just reaches the print zone 118, and FIG. 3B shows a scenario with the trailing edge of the print medium 114 leaves the print zone 118. The print medium may be longer than shown in the drawings and may extend beyond the media input zone 116 in FIG. 3A and the media output zone 120 in FIG. 3B, respectively.

The upper surface of the platen 42 is provided with a plurality of suction ports 122 in the form of small holes distributed across the entire platen 42. The suction ports 122 are in fluid communication with the vacuum chamber (not shown in FIGS. 3A and 3B) located underneath the platen 42. A vacuum source such as a fan or pump (not shown in FIGS. 3A and 3B) is located in or in fluid communication with the vacuum chamber and establishes a vacuum in the vacuum chamber. A vacuum may be characterized in terms of a reduced pressure with respect to the pressure in the surrounding environment, such as with respect to an atmospheric pressure. Due to the fluid communication with the suction ports 122, the vacuum in the vacuum chamber applies a suction force to the underside of the print medium 114 on the platen 42.

The vacuum belts 112*a* to 112*f* on the surface of the platen 42 may likewise be provided with little holes or openings that allow air to pass through and hence facilitate the application of the suction force to the underside of the print medium 114.

Due to the suction force, the print medium 114 is tightly held and can be positioned on the vacuum belts 112*a* to 112*f* while being advanced along the media advance direction Y. The suction force also avoids curling of the print medium 114, which could lead to media jams or degrade the printing quality.

A number of vacuum belts 112*a* to 112*f* share common rollers, such as a drive roller 26 and an idle roller 24. The vacuum holds down the print medium, provided flatness for accurate ink dot placement and providing a normal force to the print medium for generating traction to avoid slippage of media-to-belt when the print medium is transported by the vacuum belts 112*a*-112*f*.

Different causes can generate a media registration error in the X direction, i.e. perpendicular to the print media advance direction Y. A media registration error in the X direction may increase with an increase of media length wherein the print medium may make a kind of rotational movement defining a curve. The X axis registration error may reach a maximum when there is equilibrium between a tension force applied to the print medium in the media advance direction and a traction force applied to the print medium for holding the print medium on the media advance system. This is explained with reference to FIGS. 4A, 4B, 5A and 5B.

Figure 4B:
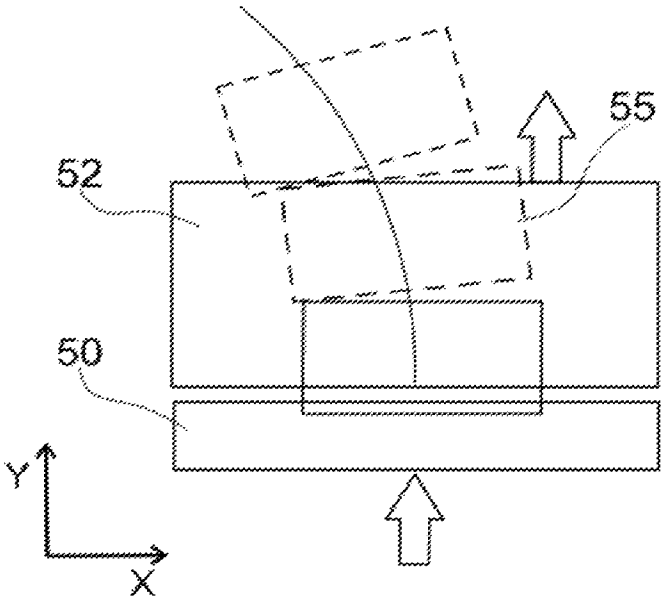
FIGS. 4A and 4B show schematic top views of a media advance system according to another example.
Figure 4A:
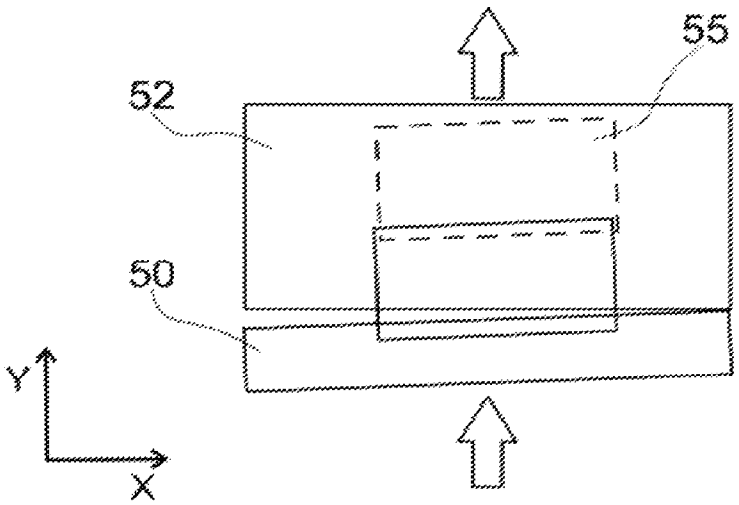

FIG. 4A shows an example where a single sheet feeder 50 feeds a single sheet of print medium 55 to a media advance system 52. An initial position of the print medium 55 is shown in solid lines and subsequent positions are shown in broken lines. If the sheet feeder 50 is misaligned relative to the media advance system 52, e.g. tilted at an angle, this causes a skew of the print medium when it is transported through the print zone. This in turn causes a linear error in the X direction of the print media position. For example, if the feeder 50 is angled at 0.5° relative to the advance direction, the print medium 55 will have the same angle and will be transported through the print zone at the same angle. This results in a slope of 8.7 mm/m, which means that the lateral position (position in the X direction) of the print medium at a predetermined position in the Y direction will move by 8.7 mm after one meter (1 m) of media advance in the media advance or Y direction.

FIG. 4B shows another example where a single sheet feeder 50 feeds a single sheet of print medium 55 to a media advance system 52. In this case, it is assumed that the print medium is transported on two vacuum belts and the two neighboring vacuum belts of the media advance system 52 run at different speeds. The two sides of the print medium 55 are transported each on one of the two neighboring vacuum belts and will move at a different speed in the media advance direction Y. This causes the print medium 55 to rotate, causing a non-linear misalignment of the print medium 55 relative to the print heads. The initial position of the print medium 55, when it enters the media advance system 52, is shown in solid lines and subsequent positions are shown in broken lines. For short plots or short print media, this might be negligible. However, for longer plots, e.g. having a length of 1 m or above, where the Y dimension of the print medium is much bigger than the X dimension, the rotation may cause a noticeable position error of the print medium in the X direction. A small differential advance between the two sides of the print medium can cause a significant position error in the X direction. An example of a "long plot" is a plot on a print medium having a length of 80 cm or above, 1 m or above, 1.2 m or above, or having a length which is 2.5 times its width or more.

If using vacuum belts, a non-symmetric belt speed profile can be caused by a misalignment between drive rollers or the use of vacuum belts generating non-homogeneous friction forces distributed across the print medium, for example.

Another cause for a position error can be the use of a grit roller for transporting the print medium having a conical shape in the roller.

Figure 5B:
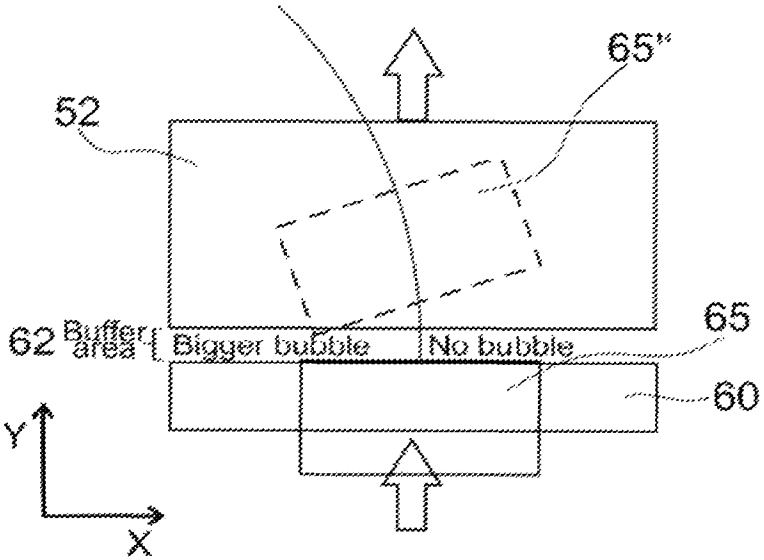
FIGS. 5A and 5B show schematic top views of a media advance system according to another example.
Figure 5A:
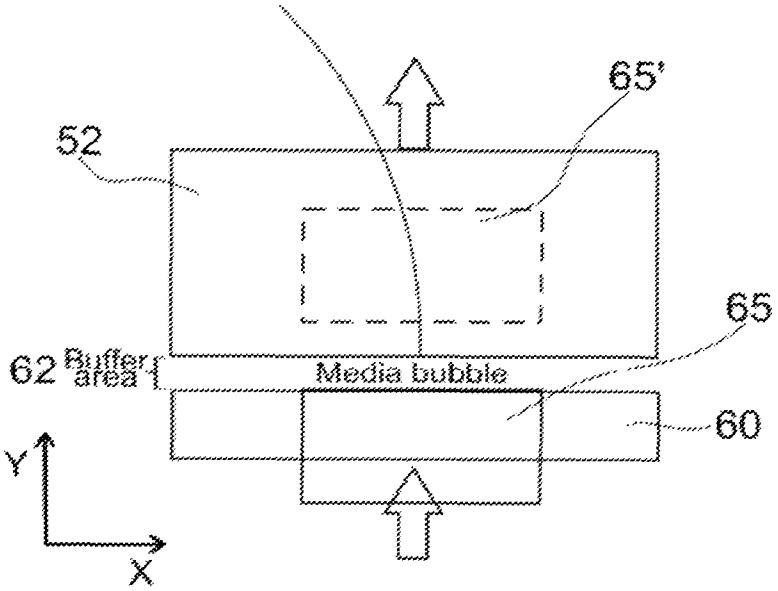

FIGS. 5A and 5B show a similar scenario as FIG. 4B for a "long plot", as defined above, i.e. for a plot which is printed on a print medium having a length of e.g. 80 cm or above, or 1 m or above, or 1.2 m or above. In FIG. 5A, a print medium 65 for a long plot is fed from a sheet feeder 60 to the media advance system 52, with a buffer area 62 between the sheet feeder 60 and the media advance system 52. The buffer area 62, in an example, may be provided between the first set 16 and the second set 18 of feed rollers/pinch wheels, as shown in FIGS. 1 and 2. A media bubble may be generated in the buffer area 62 between the sheet feeder 60 and the media advance system 52, as explained with reference to FIGS. 1 and 2. A portion 65 of the print medium, when the print medium traverses the sheet feeder 60, is represented in solid lines; and a further portion 65' of the print medium, when the print medium traverses the media advance system, is represented in broken lines. Both portions 65, 65' are part of a continuous web of the print medium for producing a "long plot".

In FIG. 5B, it is assumed that the print medium has advanced further and the rotation angle of the print medium 65 has increased continuously with the advance of the medium 65 in the Y direction. The portion 65" of the print medium has reached a stable X position where the force that makes the print medium rotate is equal to the tension force applied to the print medium between the media advance system and the upstream feed rollers/pinch wheels, i.e. there is an equilibrium between the tension force and the traction force applied to the print medium. In this scenario, the media bubble on one side of the print medium, opposite to the rotation center (in FIG. 5B at the right-hand side), has been consumed so that the print medium is fully tensioned and flat at the respective edge; and the media bubble on the other side of the print medium, facing the rotation center (in FIG. 5B at the left-hand side), has increased because the print medium is compressed at the respective edge. This can be expressed as no-media-bubble and bigger-media-bubble at the two edges of the print medium 65.

In the scenario FIG. 5B, the tension applied to the print medium has increased to a level where it is equal to the traction force applied to the print medium by the vacuum belts. In this stable position, the tension force may at least partially overcome the traction force so that the print medium slips in the X direction and compensates for at least some of the X position registration error. Accordingly, there is a dependency between the traction force generated by the vacuum belts and tension force used to overcome the traction force. The higher the vacuum level, the higher the tension force to make the medium slip in the X direction and, accordingly, the larger will be the stable angle of the print medium and hence the absolute registration error in the X position of the print medium within the print zone.

The X axis registration error can be reduced if the stable position is obtained at a lower tension force. On the other hand, the traction force should not be lowered arbitrarily. A certain minimum traction should be maintained when the leading edge and the trailing edge of the print medium enter and leave the print zone. A minimum vacuum level at the beginning and at the end of the plot also is useful to create a normal force to iron the leading and the trailing edges of the print media.

The vacuum level generated in the vacuum chamber and hence the normal force (suction force) applied to the print medium 65 can be varied to according to the position of the print medium 65 in the media advance system 52 and relative to the print zone (118 in FIGS. 3A and 3B). For example, a first higher vacuum level can be applied to the print medium to generate a higher traction force when the print medium enters the media advance system until it fully covers the print zone, and a second lower vacuum level can be applied to the print medium to generate a lower traction force while the print medium fully covers the print zone. Further, a third or the first higher vacuum level also can be applied to the print medium when the trailing edge of the print medium leaves the print zone. In a state where the lower vacuum level is applied, any media registration error in the X direction can be more readily corrected by a lower tension force applied to the print medium moving across the media advance system.

Figure 6:
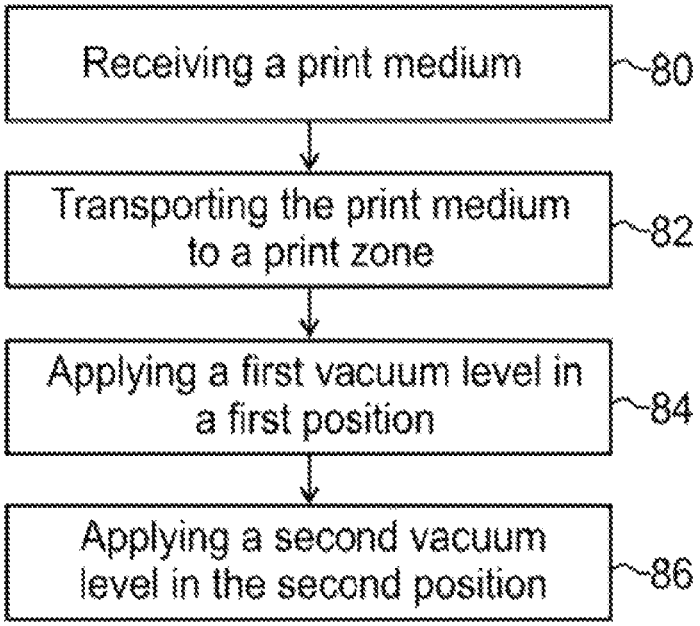
FIG. 6 shows a flow diagram of a process of feeding a print medium according to an example.

FIG. 6 shows a process flow of an example of a method of feeding a print medium. The method comprises: receiving 80 a print medium by a media advance system; and transporting 82 the print medium by the media advance system to a print zone, such as print zone 118 in FIGS. 3A and 3B. Transporting comprises applying 84 a first normal force when the print medium is at a first position of the media advance system and applying 86 a second normal force when the print medium is at a second position of the media advance system, wherein the second normal force is different from the first normal force. Applying the first normal force may comprise applying a first vacuum level to the print medium and applying the second normal force may comprise applying a second vacuum level to the print medium wherein the second vacuum level is smaller than the first vacuum level. In the following description, reference is made to the vacuum level with the understanding that the vacuum level creates a normal force or traction force which holds the print medium on the vacuum belts and platen.

By varying the vacuum level in response to the position of the print medium in the media advance system, a higher vacuum level can be used in those instances where the print medium is to be flattened and "ironed" to the platen. This is particularly the case in the leading edge and the trailing edge areas of the print medium where a print medium coming from a roll is curled due to the roll shape. Accordingly, in one example, the first higher vacuum level can be applied from the time when the print medium enters the platen of the print media advance system until it fully covers the print zone or reaches the end of the print zone in the media advance direction. In another example, the first higher vacuum level can be applied until the leading edge of the print medium has passed the print zone by a predetermined distance. In a further example, the first higher vacuum level can be applied until the leading edge of the print medium has reached the end of the platen and the print medium fully covers the length of the platen. The second lower vacuum level than can be applied as soon as the leading edge of the print medium fully covers the print zone or has passed print zone by the predetermined distance or fully covers the length of the platen, depending on the condition defined for the first vacuum level. Further, it is possible to again apply the first higher vacuum level or a third higher vacuum level before the trailing edge of the print medium reaches the print zone. In one example, the first higher vacuum level can be applied again from the time when the trailing edge of the print medium reaches the start of the print zone in the media advance direction. In another example, the first higher vacuum level can be applied again when the trailing edge of the print medium is upstream of the print zone by a predetermined distance. In a further example, the first higher vacuum level can be applied again when the trailing edge of the print medium reaches the start of the platen.

The first higher vacuum level ensures that the leading edge area and the trailing edge area of the print medium are flattened, with good traction force, on the platen of the media advance system. Once the print medium fully covers the print zone, the traction force can be reduced and the middle part of the print medium, between the leading edge area and the trailing edge area, can still be sufficiently flattened by the combined traction and tension forces applied to the print medium.

A certain minimum vacuum level normal force should be maintained to keep the print medium "ironed" all along the plot. The normal force is directly proportional to the pressure drop at the print medium:

$$F_{Normal}=\Delta P\, A_{hole} c_a$$

With $F_{Normal}$, normal force;

$\Delta P$, pressure drop at print medium;

$A_{hole}$, hole area covered by print medium;

$c_a$, influence area coefficient, depends on media air flow permeability.

In the same way, the traction force avoids media slippage and it is directly proportional to the pressure drop at the print medium.

$$F_{traction}=\mu\Delta P\, A_{hole} c_a=\mu F_{Normal}$$

With $F_{traction}$, traction force;

$\mu$, coefficient of friction between vacuum belts and print medium;

$\Delta P$, pressure drop at print medium;

$A_{hole}$, hole area covered by print medium;

$c_a$, influence area coefficient, depends on media air flow permeability.

Figure 7:
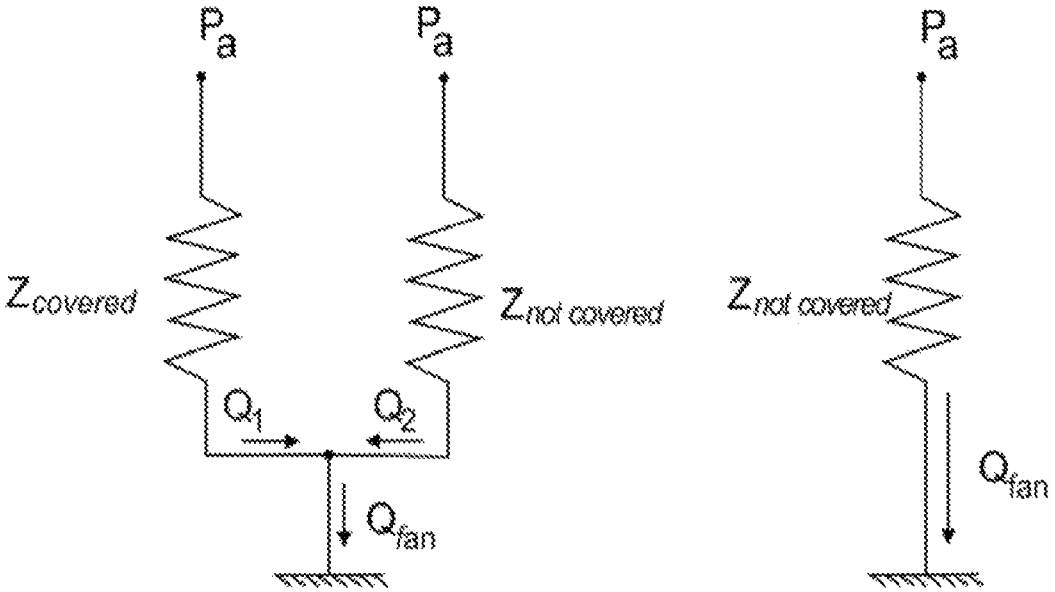
FIG. 7 shows a simplified vacuum system mass flow transitory scheme according to an example.

In general, the pressure drop is lower when the platen is partially covered by the print medium and the impedance of the system is is lower than the nominal impedance value of the media advance system when the platen is fully covered. FIG. 7 shows a very simple scheme of the impedances of a platen vacuum system partially covered and completely covered by a print medium. In this diagram, the pressure drop P at the print medium corresponds to a voltage; the mass flow of air Q corresponds to a current, and the impedance Z corresponds to a resistance. The impedance Z is a function of media porosity, the number and size of vacuum holes in the platen and the vacuum belts, the air resistance of the ducts and air feed elements or, more generally, any airflow resistance to the vacuum generator. The impedance Z is different in areas covered by the print medium and areas not covered by the print medium.

In this example, $Z_{not\ covered}$ is the impedance for the system itself, taking into account the geometrical features of the vacuum system (pipes, elbows, pre-chambers, holes, belts hole, etc.). $Z_{covered}$ includes the same impedance due to all the geometrical features plus the impedance of the print medium. This impedance is different for each print medium depending on its permeability but usually is much higher than the impedance of the media advance system (not covered). These two impedances are changing over time while the print medium moves across the platen. The equivalent impedance of the system when it is not totally covered is:

$$Z_{eq}=\frac{1}{\dfrac{Z_{cov}+Z_{notCov}+2\sqrt{Z_{cov}Z_{notCov}}}{Z_{cov}Z_{notCov}}}$$

In order to have a minimum normal force and traction force when the leading edge area and the trailing edge area of the print medium cross the print zone, the first higher vacuum level may be in the range of 80 $mmH_2O$ to 120 $mmH_2O$ (about 800 Pa to 1200 Pa), such as at about 80 $mmH_2O$ (about 800 Pa), 100 $mmH_2O$ (about 1000 Pa) or 120 $mmH_2O$ (about 1200 Pa), for example, depending on media type. When the print zone is totally covered, the vacuum level can be lowered to a range of 10 $mmH_2O$ to 50 $mmH_2O$ (about 100 Pa to 500 Pa) or about 20 $mmH_2O$ (about 200 Pa) or about 30 $mmH_2O$ (about 300 Pa), for example. The first vacuum level may be about twice to about ten times the second vacuum level, or about five times the second vacuum level. When the print zone is fully covered and/or when the platen is fully covered by the print medium, the impedance of the system is relatively high due to the media impedance, so the pressure drop at the print medium is high. Additionally the hole area covered by the print medium, $A_{hole}$, reaches its maximum value during this state. Accordingly, the vacuum level can be reduced.

In one example, at any one point in time, the same vacuum level, either the first vacuum level or the second vacuum level or the third vacuum level, is applied throughout the platen. In another example, the vacuum level may be different in different areas of the platen, e.g. to accommodate different print media widths. The third vacuum level may be provided when the trailing edge of the print medium leaves the print zone wherein the third vacuum level is higher than the second vacuum level and may be the same as the first vacuum level or may be higher or lower than the first vacuum level.

Lowering the vacuum level reduces the normal and traction forces, allowing a small media slippage in X direction. Accordingly, the equilibrium between the tension force applied to the print medium in the media advance direction and the traction force applied to the print medium for holding the print medium on the media advance system is reached at a smaller rotation angle and the X axis registration error is reduced accordingly. As a result, the print medium can be fed with a small media bubble in a low position of the bubble sensor to generate an X-direction slippage opposite to the media X movement once the bubble has been consumed in one side of the buffer (see FIG. 5B). The media bubble may be smaller than a media bubble size which the bubble sensor is able to measure. Using a smaller bubble size, the buffer that has to be consumed to achieve equilibrium can be brought to a minimum. A bigger media bubble may be generated to allow media cutting without stopping at the end of the plot when the higher vacuum level is applied. By controlling, i.e. increasing and reducing, the vacuum level and bubble size along the plot during the printing operation, the media stabilization point in X direction can be modified.

The described concept achieves robustness when feeding a long print medium in a printer, having regard to media position errors in X direction. Even for long print media, having a length of 1 m or more, for example, a stable position in the X direction and a quite small rotation angle of the print medium can be achieved. The absolute X position error can be kept low, minimizing the image position errors, even for very long plots where it is difficult to keep the initial margin of the paper all along the plot. Additionally, the occurrence of wrinkles in the media input area due to the misalignment between the media actual position in the print zone and the feeding position can be mitigated.

The invention claimed is:

1. A method of feeding a print medium, the method comprising: receiving a print medium by a media advance system, wherein the media advance system generates a bubble in the print medium; transporting the print medium on a media advance surface of the media advance system to a print zone wherein the transporting comprises applying a first normal force when the print medium is at a first position of the media advance system and applying a second normal force when the print medium is at a second position of the media advance system, wherein the first normal force is greater than the second normal force; wherein applying the first normal force to the print medium comprises generating a higher traction force between the print medium and the media advance surface from when the print medium enters the media advance system until the print medium covers the print zone, and wherein applying the second normal force to the print medium comprises generating a lower traction force between the print medium and the media advance surface while the print medium covers the print zone, and wherein the lower traction force and the bubble allow a slippage of the print medium in a direction that is perpendicular to a media advance direction and parallel to the media advance surface.

2. The method of claim 1, wherein applying the first normal force comprises applying a first vacuum level to the print medium and applying a second normal force comprises applying a second vacuum level to the print medium wherein the second vacuum level is smaller than the first vacuum level.

3. The method of claim 2 wherein the first vacuum level is in the range of 80 $mmH_2O$ to 120 $mmH_2O$ and the second vacuum level is in the range of 10 $mmH_2O$ to 80 $mmH_2O$, or in the range of 10 $mmH_2O$ to 50 $mmH_2O$ or about 20 $mmH_2O$ or about 30 $mmH_2O$.

4. The method of claim 2 wherein the first vacuum level is about twice to about ten times the second vacuum level, or about five times the second vacuum level.

5. The method of claim 1, comprising applying a third normal force to the print medium when the trailing edge of the print medium leaves the print zone, wherein the third normal force is different from the second normal force.

6. An apparatus, comprising: a sheet media advance system including a media advance surface for supporting and advancing a sheet medium, wherein the sheet media advance system generates a bubble in the sheet medium; and a traction generator for applying a normal force to the sheet medium for holding the sheet medium on the media advance surface; wherein the traction generator is to apply a first normal force when the sheet medium is in a first portion of the sheet media advance system and a second normal force when the sheet medium is in a second portion of the sheet media advance system, wherein the first normal force is greater than the second normal force; wherein the apparatus comprises a media processing zone; wherein the traction generator is to apply the first normal force to the sheet medium to generate a higher traction force between the sheet medium and the media advance surface from when the sheet medium enters the media advance system until it reaches the media processing zone, and wherein the traction generator is to apply the second normal force to the sheet medium to generate a lower traction force between the sheet medium and the media advance surface while the sheet medium is in the media processing zone, and wherein the lower traction force and the bubble allow a slippage of the sheet medium in a direction that is perpendicular to a media advance direction and parallel to the media advance surface.

7. The apparatus of claim 6, wherein the traction generator comprises a vacuum generator to generate a first vacuum level corresponding to the first normal force and a second vacuum level corresponding to the second normal force wherein the second vacuum level is smaller than the first vacuum level.

8. The apparatus of claim 6, wherein the media advance system comprises:

a platen having ports to permit an airflow there through;

a vacuum generator associated with the platen, wherein the vacuum generator is to induce the airflow; and two transport belts superjacent the platen, having an array of belt perforations;

the vacuum generator to generate a first vacuum level corresponding to the first normal force by airflow through the platen and the transport belts and a second vacuum level corresponding to the second normal force by airflow through the platen and the transport belts wherein the second vacuum level is smaller than the first vacuum level.

9. The apparatus of claim 8, wherein the media processing zone is a print zone defined in the sheet media advance system wherein the belts extend through the print zone for transporting the sheet medium into and out of the print zone.

10. The apparatus of claim 8 further comprising a controller coupled to the vacuum generator to control the vacuum level as a function of the sheet media position relative to the sheet media advance system and as a function of the sheet media size.

11. A printer including: a print bar arranged across a print zone: a media advance system comprising: a platen having ports to permit an airflow there through; a vacuum generator associated with the platen, wherein the vacuum generator is to induce the airflow; and two transport belts superjacent the platen for transporting a print medium through the print zone, wherein each transport belt comprises a contact surface, and wherein the media advance system generates a bubble in the print medium; and a controller coupled to the vacuum generator to dynamically control a vacuum level as a function of the print media position relative to the print zone, wherein the vacuum level generates a higher traction force between the print medium and the contact surfaces of the transport belts of the media advance system from when the print medium enters the media advance system until the print medium covers the print zone, and wherein the vacuum level generates a lower traction force between the print medium and the contact surfaces of the transport belts of the media advance system while the print medium covers the print zone, and wherein the lower traction force and the bubble allow a slippage of the print medium in a direction that is perpendicular to a media advance direction and along the contact surfaces of the transport belts.

12. The printer of claim 11 wherein the controller is to control the vacuum generator to generate a first vacuum level in the range of 80 $mmH_2O$ to 120 $mmH_2O$ when a leading edge of the print medium is upstream of the print zone and to generate a second vacuum level in the range of 10 $mmH_2O$ to 80 $mmH_2O$, or in the range of 10 $mmH_2O$ to 50 $mmH_2O$ or of about 20 $mmH_2O$ or about 30 $mmH_2O$ when the leading edge of the print medium is downstream of the print zone and the trailing edge of the print medium is upstream of the print zone.

* * * * *